US007627951B2

(12) United States Patent
Glesser

(10) Patent No.: US 7,627,951 B2
(45) Date of Patent: Dec. 8, 2009

(54) BI-FOLD KNIFE WITH LOCKING AND RELEASE MECHANISMS

(76) Inventor: Eric G. Glesser, 1250 Golden Cir., #508, Golden, CO (US) 80401

( * ) Notice: Subject to any disclaimer, the term of this patent is extended or adjusted under 35 U.S.C. 154(b) by 98 days.

(21) Appl. No.: 11/759,103

(22) Filed: Jun. 6, 2007

(65) Prior Publication Data

US 2008/0295337 A1 Dec. 4, 2008

Related U.S. Application Data

(63) Continuation of application No. 29/280,614, filed on Jun. 1, 2007, now Pat. No. Des. 573,864.

(51) Int. Cl.
*B26B 1/02* (2006.01)

(52) U.S. Cl. ..... 30/161; 30/153; 30/155

(58) Field of Classification Search ..... 30/155, 30/160, 161

See application file for complete search history.

(56) References Cited

U.S. PATENT DOCUMENTS

| | | | | |
|---|---|---|---|---|
| 552,077 | A | 12/1895 | Wagner | |
| 557,818 | A * | 4/1896 | Hotchkiss | 30/161 |
| 749,230 | A | 1/1904 | Severance | |
| 1,194,503 | A | 8/1916 | Jawoisch | |
| 1,803,899 | A | 5/1931 | Fuller | |
| 1,864,011 | A | 6/1932 | Brown | |
| 1,994,215 | A * | 3/1935 | Gaunt | 30/155 |
| 2,415,367 | A | 2/1947 | Pavlovic | |
| 2,481,309 | A | 9/1949 | Gunnarson | |
| D166,064 | S | 3/1952 | Blecher | |
| 2,630,114 | A | 3/1953 | Hart | |
| 3,006,443 | A | 10/1961 | Siler | |
| 3,263,329 | A | 8/1966 | Hennessy | |
| D224,388 | S | 7/1972 | Wood | |
| D224,389 | S | 7/1972 | Wood | |
| 3,731,961 | A | 5/1973 | Becker | |
| D227,071 | S | 6/1973 | Bernadotte | |
| 3,783,509 | A | 1/1974 | Lake | |
| 3,871,141 | A | 3/1975 | Bonapace | |
| D237,458 | S | 11/1975 | Laughlin | |

(Continued)

FOREIGN PATENT DOCUMENTS

| | | |
|---|---|---|
| CA | 1130567 | 8/1982 |

(Continued)

OTHER PUBLICATIONS

"The Bud K Catalog", Bud K Worldwide, Early Fall 2000, p. 3, front and back cover.

(Continued)

*Primary Examiner*—Hwei-Siu C Payer
(74) *Attorney, Agent, or Firm*—Sheridan Ross P.C.

(57) ABSTRACT

A bi-fold knife locking mechanism is provided which maintains the open and closed positions associated with the bi-fold knife. A locking and release mechanism for changing the bi-fold knife from the closed to the open position is also disclosed. An aperture in the blade portion of the bi-fold knife for ergonomically gripping the bi-fold knife is also disclosed. A locking plate for securing the locking and release mechanism and bi-fold knife in the closed position is also disclosed.

15 Claims, 3 Drawing Sheets

U.S. PATENT DOCUMENTS

| | | | | | |
|---|---|---|---|---|---|
| 3,930,309 | A | | 1/1976 | Collins | |
| 3,942,394 | A | | 3/1976 | Juranitch | |
| 4,070,011 | A | | 1/1978 | Glesser | |
| 4,083,110 | A | * | 4/1978 | Goldin et al. | 30/155 |
| 4,133,106 | A | | 1/1979 | Addis | |
| 4,170,061 | A | | 10/1979 | Henry | |
| D256,427 | S | | 8/1980 | Lile | |
| D256,981 | S | | 9/1980 | Sakurai | |
| D257,056 | S | | 9/1980 | Spivey | |
| 4,231,194 | A | | 11/1980 | Glesser | |
| D257,612 | S | | 12/1980 | Goldin et al. | |
| 4,266,591 | A | | 5/1981 | F'Geppert | |
| 4,272,887 | A | | 6/1981 | Poehlmann | |
| 4,347,665 | A | | 9/1982 | Glesser | |
| 4,393,539 | A | | 7/1983 | Weissman | |
| 4,394,096 | A | | 7/1983 | Stevens | |
| 4,447,950 | A | | 5/1984 | Mizelle | |
| 4,451,982 | A | | 6/1984 | Collins | |
| D275,448 | S | | 9/1984 | Ferraro | |
| D280,427 | S | | 9/1985 | Jones | |
| 4,604,803 | A | | 8/1986 | Sawby | |
| 4,640,058 | A | | 2/1987 | Glesser | |
| D288,898 | S | | 3/1987 | Osterhout | |
| 4,696,129 | A | | 9/1987 | Roberts | |
| 4,703,560 | A | | 11/1987 | Brooker | |
| 4,719,700 | A | | 1/1988 | Taylor, Jr. | |
| D296,518 | S | | 7/1988 | Sadler | |
| 4,759,153 | A | | 7/1988 | Cohen | |
| 4,776,094 | A | * | 10/1988 | Glesser | 30/160 |
| 4,778,094 | A | | 10/1988 | Fishback | |
| 4,805,303 | A | | 2/1989 | Gibbs | |
| 4,811,486 | A | | 3/1989 | Cunningham | |
| 4,819,289 | A | | 4/1989 | Gibbs | |
| D302,649 | S | | 8/1989 | Porsche et al. | |
| D302,650 | S | | 8/1989 | Giordano | |
| D302,934 | S | | 8/1989 | Finn | |
| D303,210 | S | | 9/1989 | Thompson | |
| D304,154 | S | | 10/1989 | Osterhout | |
| 4,901,439 | A | | 2/1990 | Boyd, Jr. | |
| D310,014 | S | | 8/1990 | Inman | |
| 4,947,551 | A | * | 8/1990 | Deisch | 30/161 |
| 4,947,552 | A | | 8/1990 | Barnes | |
| D310,621 | S | | 9/1990 | Thompson | |
| 4,974,323 | A | | 12/1990 | Cassady | |
| 4,985,998 | A | | 1/1991 | Howard | |
| D317,037 | S | | 5/1991 | Koshiishi | |
| 5,044,079 | A | | 9/1991 | Gibbs | |
| 5,060,379 | A | | 10/1991 | Neely | |
| 5,060,890 | A | | 10/1991 | Utterback et al. | |
| D321,820 | S | | 11/1991 | Russell | |
| D324,899 | S | | 3/1992 | Thompson | |
| 5,093,995 | A | | 3/1992 | Jan | |
| 5,095,624 | A | * | 3/1992 | Ennis | 30/161 |
| 5,111,581 | A | | 5/1992 | Collins | |
| 5,131,149 | A | | 7/1992 | Thompson et al. | |
| D333,081 | S | | 2/1993 | Glesser | |
| D333,251 | S | | 2/1993 | Glesser | |
| D333,859 | S | | 3/1993 | Meyer | |
| D337,253 | S | | 7/1993 | Glesser | |
| D344,006 | S | | 2/1994 | Glesser | |
| D347,375 | S | | 5/1994 | Sakai | |
| D348,599 | S | | 7/1994 | Sakai | |
| 5,325,588 | A | | 7/1994 | Rogers | |
| D349,837 | S | | 8/1994 | Glesser | |
| D353,988 | S | | 1/1995 | Glesser | |
| 5,379,492 | A | | 1/1995 | Glesser | |
| D356,723 | S | | 3/1995 | Sakai | |
| 5,400,509 | A | | 3/1995 | Collins | |
| 5,425,175 | A | | 6/1995 | Rogers | |
| D363,871 | S | | 11/1995 | Coggins | |
| D365,266 | S | | 12/1995 | Hasegawa | |
| D366,408 | S | | 1/1996 | Sessions et al. | |
| D367,599 | S | | 3/1996 | Sakai | |
| 5,495,673 | A | | 3/1996 | Gardiner et al. | |
| 5,495,674 | A | | 3/1996 | Taylor, Jr. | |
| 5,502,895 | A | | 4/1996 | Lemaire | |
| 5,511,310 | A | | 4/1996 | Sessions et al. | |
| 5,537,750 | A | | 7/1996 | Seber et al. | |
| 5,542,139 | A | | 8/1996 | Boivin | |
| 5,546,662 | A | | 8/1996 | Seber et al. | |
| D373,716 | S | | 9/1996 | Keys et al. | |
| 5,572,793 | A | | 11/1996 | Collins et al. | |
| 5,580,019 | A | | 12/1996 | Glesser | |
| 5,581,888 | A | | 12/1996 | Lewis | |
| D377,443 | S | | 1/1997 | Seber et al. | |
| 5,594,966 | A | | 1/1997 | Goldman | |
| 5,596,808 | A | | 1/1997 | Lake et al. | |
| D378,982 | S | | 4/1997 | Thompson | |
| 5,615,484 | A | | 4/1997 | Pittman | |
| D379,294 | S | | 5/1997 | Lum | |
| 5,628,117 | A | | 5/1997 | Glesser | |
| D379,579 | S | | 6/1997 | Pohl | |
| D381,060 | S | | 7/1997 | Moran | |
| D382,189 | S | | 8/1997 | Viele | |
| D382,459 | S | | 8/1997 | Khalsa | |
| 5,661,908 | A | | 9/1997 | Chen | |
| D384,871 | S | | 10/1997 | McWillis | |
| D385,173 | S | | 10/1997 | McWillis | |
| D386,664 | S | | 11/1997 | Glesser | |
| 5,685,079 | A | | 11/1997 | Brothers et al. | |
| 5,689,890 | A | | 11/1997 | Glesser | |
| D387,966 | S | | 12/1997 | Horn | |
| D388,150 | S | | 12/1997 | Glesser | |
| D389,389 | S | | 1/1998 | Glesser | |
| D389,718 | S | | 1/1998 | Wegner | |
| 5,704,129 | A | | 1/1998 | Glesser | |
| D391,465 | S | | 3/1998 | Glesser | |
| D392,539 | S | | 3/1998 | Balolia | |
| 5,722,168 | A | | 3/1998 | Huang | |
| 5,737,841 | A | | 4/1998 | McHenry et al. | |
| 5,755,035 | A | | 5/1998 | Weatherly | |
| D396,657 | S | | 8/1998 | Nagai et al. | |
| D397,017 | S | | 8/1998 | Pardue | |
| 5,794,346 | A | | 8/1998 | Seber et al. | |
| 5,799,400 | A | | 9/1998 | Glesser | |
| 5,826,340 | A | | 10/1998 | Hull | |
| D402,178 | S | | 12/1998 | Glesser | |
| D402,524 | S | | 12/1998 | Glesser | |
| D403,567 | S | | 1/1999 | Glesser | |
| D404,990 | S | | 2/1999 | Zowada | |
| D405,338 | S | | 2/1999 | Balolia | |
| D407,002 | S | | 3/1999 | Morton et al. | |
| 5,878,500 | A | | 3/1999 | Emerson | |
| 5,887,347 | A | | 3/1999 | Gibbs | |
| D411,431 | S | | 6/1999 | Glesser | |
| D411,790 | S | | 7/1999 | Glesser | |
| D412,355 | S | | 7/1999 | Saetherbo | |
| 5,920,935 | A | | 7/1999 | Beck | |
| 5,953,821 | A | * | 9/1999 | Mearns | 30/161 |
| 5,964,036 | A | | 10/1999 | Centofante | |
| 5,983,506 | A | | 11/1999 | Glesser | |
| D418,383 | S | | 1/2000 | Bradichansky | |
| D421,378 | S | | 3/2000 | Glesser | |
| D422,871 | S | | 4/2000 | Terzuola | |
| D425,391 | S | | 5/2000 | Bradichansky | |
| 6,088,861 | A | | 7/2000 | Sessions et al. | |
| D429,138 | S | | 8/2000 | Glesser | |
| 6,101,722 | A | * | 8/2000 | Cheng | 30/155 |
| 6,101,723 | A | | 8/2000 | Ford | |
| 6,122,829 | A | | 9/2000 | McHenry et al. | |
| 6,125,543 | A | | 10/2000 | Jhones | |
| D434,631 | S | | 12/2000 | Lum | |
| D435,420 | S | | 12/2000 | Ayoob | |
| 6,154,965 | A | | 12/2000 | Sakai | |

| | | | | |
|---|---|---|---|---|
| D436,014 | S | 1/2001 | Glesser | |
| D438,443 | S | 3/2001 | Keating | |
| 6,205,667 | B1 | 3/2001 | Glesser | |
| D441,827 | S | 5/2001 | Frank | |
| D442,460 | S | 5/2001 | Glesser | |
| D442,461 | S | 5/2001 | Glesser | |
| D442,841 | S | 5/2001 | Balolia | |
| 6,305,085 | B1 * | 10/2001 | Stallegger et al. | 30/161 |
| 6,360,443 | B1 | 3/2002 | Remus | |
| 6,363,615 | B1 * | 4/2002 | Moser | 30/161 |
| 6,370,778 | B1 * | 4/2002 | Conable | 30/161 |
| 6,397,477 | B1 | 6/2002 | Collins | |
| D461,387 | S | 8/2002 | Glesser | |
| D464,551 | S | 10/2002 | Glesser | |
| 6,490,797 | B1 | 12/2002 | Lake et al. | |
| 6,523,265 | B2 | 2/2003 | Eickhorn | |
| 6,553,672 | B2 | 4/2003 | Glesser et al. | |
| D474,669 | S | 5/2003 | Onion | |
| 6,574,869 | B1 | 6/2003 | McHenry et al. | |
| 6,591,505 | B2 | 7/2003 | Flavigny | |
| 6,725,545 | B2 | 4/2004 | Frank | |
| 6,751,868 | B2 | 6/2004 | Glesser | |
| D495,940 | S | 9/2004 | Keppel et al. | |
| 6,918,184 | B2 | 7/2005 | Glesser | |
| D509,124 | S | 9/2005 | Keppel et al. | |
| D520,843 | S | 5/2006 | Voros | |
| D523,317 | S | 6/2006 | Ryan et al. | |
| 7,249,417 | B2 * | 7/2007 | Chu | 30/155 |
| D553,467 | S | 10/2007 | Ryan | |
| 7,340,836 | B2 * | 3/2008 | Whitemiller et al. | 30/152 |
| D573,864 | S * | 7/2008 | Glesser | D8/99 |
| D581,240 | S | 11/2008 | Glesser et al. | |
| 2006/0168817 | A1 * | 8/2006 | Kao | 30/153 |

FOREIGN PATENT DOCUMENTS

| | | |
|---|---|---|
| DE | 3041584 | 6/1982 |
| DE | 3217529 | 1/1983 |
| DE | 3834295 | 7/1989 |
| FR | 2495-986 | 6/1982 |
| GB | 189822620 | 12/1898 |
| GB | 2084058 | 9/1980 |

OTHER PUBLICATIONS

"Ironstone", Catalog of Knives and Accessories, Fall/Winter 1995-1996, cover, pp. 6-7 and 10-13.
"Dear Spyderco Customer" Letter from Spyderco, Inc., Nov. 1, 2006, 2 pages.
"To Our Valuable Distributors and Dealers" Letter from Spyderco, Inc., Nov. 1, 2006, 4 pages.
"SpyderEdge", Spyderco, Inc., 4th Quarter, 2001, pp. 1-6.
"Spyderco 2007 Dealer Pricing", Spyderco, Inc., 2007, 4 pages.
"Welcome to the World of Spyderco", Spyderco Brochure, Spyderco, Inc., 1998, 42 pages.
"Spyderco 2001" Spyderco, Inc. 2001, 2 pages.
"Spyderco 2002" Spyderco, Inc. 2002, 3 pages.
"K.I.S.S. & P.E.C.K." website pages from www.crkt.com/kiss.html, dated Jun. 2, 2008, 3 pages.

* cited by examiner

BI-FOLD KNIFE WITH LOCKING AND RELEASE MECHANISMS

CROSS REFERENCE TO RELATED APPLICATIONS

The present invention claims the benefit of U.S. patent Ser. No. 29/280,614, filed Jun. 1, 2007 which is incorporated by reference in its entirety herein.

FIELD OF THE INVENTION

The present invention is related to cutting instruments, and more specifically bi-fold knives with locking and release mechanisms to maintain open and closed positions associated with the bi-fold knife.

BACKGROUND OF THE INVENTION

Cutting instruments have been used for centuries by craftsmen, hunters, and others requiring a sharp cutting instrument. More recently, fixed length knives have been replaced with popular folding knives, including bi-fold knives, which generally have two positions. In a first extended position of use, the knife cutting blade is extended to expose the blade cutting edge and permit cutting therein. In a second closed position, the cutting edge of the blade is stored within a cavity or recess in the handle portion of the knife, thus preventing the blade from being exposed. The folding mechanism further provides a cutting instrument which is much shorter in length than a typical fixed blade knife. As discussed herein, the term "bi-fold" refers to a folding knife where the blade rotates at a hinge point on the handle and is positioned adjacent to the handle portion as depicted herein in the drawings. Although these types of knives are extremely convenient, they can potentially become dangerous if the cutting blade does not have a locking mechanism to securely keep the knife blade in the first extended position of use. Likewise, it is often convenient to have a locking mechanism or some form of frictional ball détente apparatus to prevent the knife from inadvertently opening when the knife blade is in the second closed position.

Although there are other types of locking mechanisms used to prevent the inadvertent closure of a folding knife blade, none are simplistic to use, inexpensive to manufacture and are essentially fail-proof. Thus, there is a need for a type of bi-fold folding knife locking mechanism which is simplistic to use, inexpensive to manufacture, and provides substantial strength to prevent any inadvertent failure.

SUMMARY OF THE INVENTION

It is thus an object of the present invention to provide a bi-fold knife locking mechanism which is secure and easily activated when the blade is in an extended position of use. It is a further object of the present invention that the bi-fold knife locking mechanism be designed to use a minimum number of components, thus making the locking mechanism inexpensive to manufacture, simplistic in design, and encompassing a variety of different embodiments of a bi-fold knife.

Thus, in one aspect of the present invention, a bi-fold knife is provided which includes a locking mechanism for preventing movement of a folding mechanism, such as a hinge, thereby securing the bi-fold knife in an opened position.

In another aspect of the invention, the locking mechanism is in operable contact with a latching mechanism, such as a détente mechanism, for securing the hingedly connected portions to one another in a closed position.

In yet another aspect of the invention, the locking mechanism may be secured in its latched position (corresponding to the bi-fold knife in its closed position) by engaging a locking plate, which shifts from a first position to a second position to secure the locking mechanism from movement to release the détente mechanism.

Thus, in one particular aspect or embodiment of the present invention, a bi-fold knife is provided which generally comprises:

a blade having a front end and a tang;

a handle having a front end and a rear end, said tang end of said blade rotatably interconnected to said front end of said handle by a hinge;

a slot positioned in at least one of said hinge and said tang;

a détente mechanism extending from said blade;

a locking mechanism for locking said blade in a open position or a closed position, said locking mechanism rotatable about a pivot point from a first position to a second position; and wherein a latch on said locking mechanism engages said slot in said first position for locking said bi-fold knife in said open position, wherein said latch is released from said slot to allow the rotation of said blade and said handle to said closed position, and wherein said détente mechanism contacts and engages said locking mechanism for locking said blade in said closed position.

In another embodiment, a bi-fold knife is provided which generally comprises:

a first portion comprising at least one blade and a hinge;

a second portion connected to said first portion by said hinge;

a locking post extending from said first portion;

a locking mechanism attached to and pivotable about at least a part of said second portion for locking said folding knife in a open position or a closed position; and wherein said locking mechanism is in operable contact with said first portion in one position for locking said folding knife in said open position, and wherein said locking mechanism is in operable contact with said locking post in another position for locking said folding knife in said closed position.

In another embodiment of the present invention, an aperture in the blade portion is adapted for receiving a user's finger, wherein a portion of the knife blade is effectively used as a portion of the knife handle for gripping the cutting instrument.

DETAILED DESCRIPTION

Figure 1:
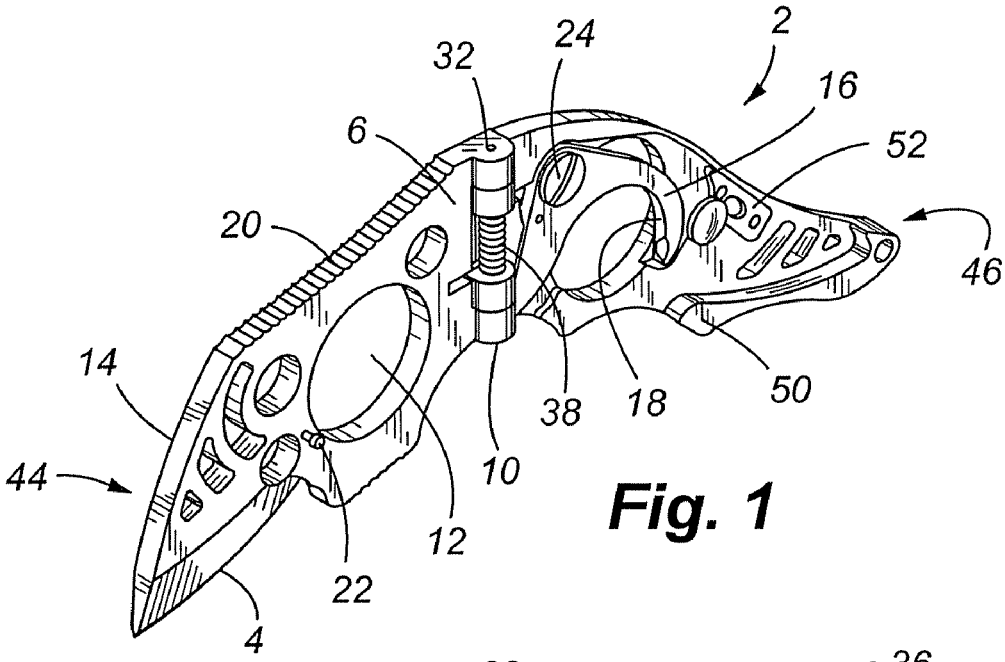
FIG. 1 is a front perspective view of a bi-fold knife, according to one embodiment of the invention.

As described in detail below, various embodiments of the present invention include novel bi-fold knife designs and configurations, comprising one or more locking and release mechanisms and/or other features. Referring now to the drawings, FIG. 1 represents one particular embodiment of the present invention and generally depicts a bi-fold knife in a first open position with the knife blade available for use. In general, the bi-fold knife 2 comprises a blade portion 44 hingedly connected to a handle portion 46. The blade portion 44 generally comprises a blade 4 opposite a spine 14 towards its forward end. The blade portion 44 may further comprise a finger aperture 12 and a serrated edge 20, as shown in FIG. 1. The handle portion 46 comprises a handle and a locking mechanism 16. The handle portion 46 is connected to the blade portion by a hinge 10 and a hinge pin 32. The handle further comprises contours for placement of individual fingers to grasp the bi-fold knife 2.

Figure 2:
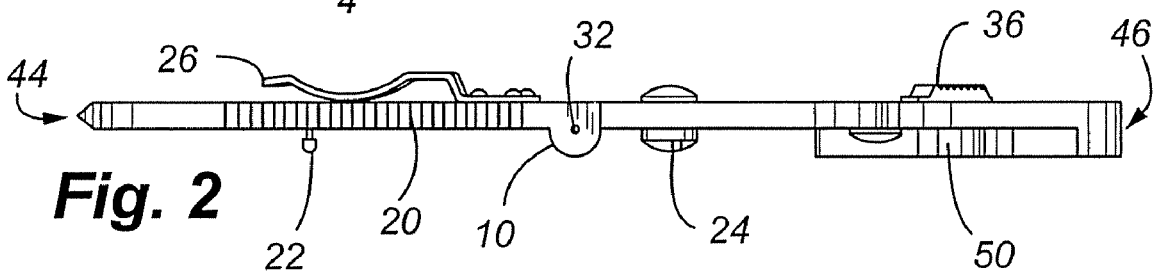
FIG. 2 is a top plan view of the bi-fold knife of FIG. 1.

Referring now to FIG. 2, the bi-fold knife 2 in an open position is shown in a top plan view. In one embodiment, the geometry of the bi-fold knife 2 is such that the blade portion 44 is substantially symmetrical with the handle portion 46 about an axis centered through the hinge pin 32. The geometry of the assembly is such that when bi-fold knife 2 is in an open position, the handle portion 46 is approximately the same length as the blade portion 44. In other words, the distance from the hinge pin 32 to the distal end of the handle portion 46 is approximately equal to the distance from the hinge pin 32 to the distal end of the blade portion 44. As shown in FIG. 2, the handle portion 46 comprises a first extension 50 which creates a recessed portion for accommodating a safe placement of the blade 4 when the bi-fold knife 2 is in a closed position. The blade portion 44 in one embodiment further comprises a clip 26 for attaching to an article of clothing or a belt or the like. Also shown in FIG. 2, a detent mechanism 22 extends outwardly from the surface of the blade portion 44 and is positioned to contact the locking mechanism 16 to secure the bi-fold knife 2 in a closed position as described in greater detail below.

As shown in FIGS. 1 and 2, the blade portion 44 and the handle portion 46 of bi-fold knife 2 are hingedly connected near the tang 6 of blade portion 44 by hinge 10. The hinge 10 extends throughout the minor axis of bi-fold knife 2, thereby allowing movement of the blade portion 44 and the handle portion 46 relative to one another such that bi-fold knife 2 may be positioned in an opened or a closed position. Hinge 10 further comprises a biasing member 38, causing the blade portion 44 and the handle portion 46 to move axially about the hinge 10 relative to one another, which biases the bi-fold knife 2 to a normally opened position.

The locking mechanism 16 provides limited movement about the lock pivot point 24 to accommodate locking of the bi-fold knife 2 in an opened position and/or release of the locking mechanism 16 to allow the bi-fold knife 2 to be closed. Locking mechanism 16 may be biased by a spring 8 located at lock pivot point 24 such that spring 8 normally biases the locking mechanism 16 in a clockwise direction. This positive rotation causes the locking mechanism 16 to become engaged with a slot 42 in hinge 10 when the bi-fold knife 2 is in a fully opened position. When locking mechanism 16 is engaged with slot 42, the hinge 10 may not operate and the bi-fold knife 2 is maintained in an open position. Thus, bi-fold knife 2 may not be closed without first rotating locking mechanism 16 about lock pivot point 24 to disengage the locking mechanism 16 from slot 42 to allow rotation of the blade portion 44 and the handle portion 46 about the hinge pin 32.

Figure 3:
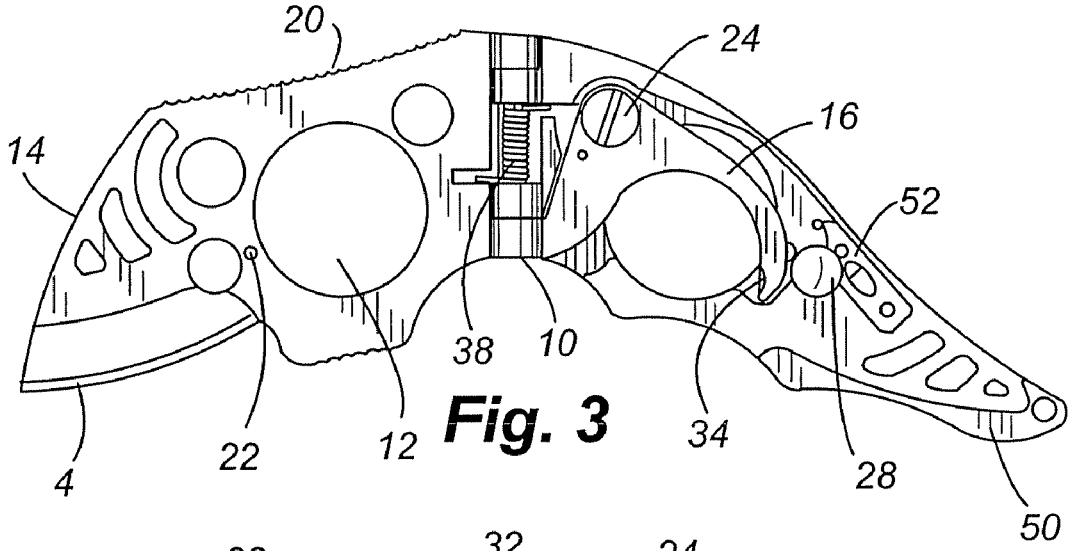
FIG. 3 is a front elevation view of the bi-fold knife of FIG. 1.

Referring now in detail to FIG. 3, a front elevation view of the bi-fold knife 2 is shown. In this embodiment, the locking mechanism 16 is pivotally connected to the handle 30 at the lock pivot point 24. Thus, the locking mechanism 16 is movable from a first position to a second position by the insertion of a finger into the finger aperture 12 and movement against a finger engagement surface 18. This movement causes rotation of the locking mechanism 16 from a first position to a second position. Thus, the locking mechanism 16 and finger engagement surface 18 allow a finger of a user to be inserted into the finger aperture 12 of the handle portion 46 of the bi-fold knife 2, and allow rotation of the locking mechanism 16 to become disengaged from the slot 42 to operate the hinge 10 and close the bi-fold knife 2 (as shown in relation to FIG. 10 below).

Figure 4:
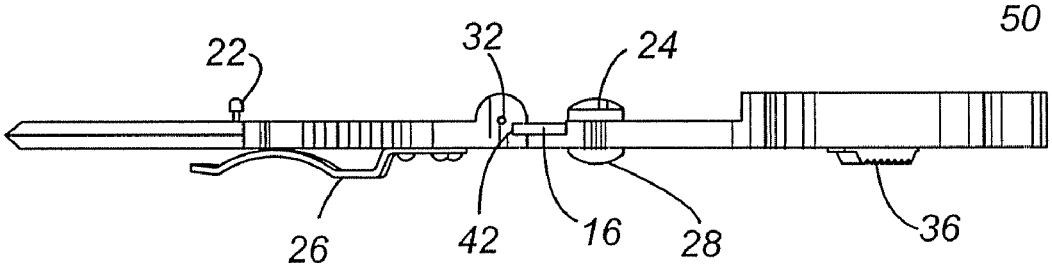
FIG. 4 is a bottom plan view of the bi-fold knife of FIG. 1.

Referring now to FIG. 4, the locking mechanism 16 in this embodiment may further comprise an extended portion or latch for engaging the slot 42 when the locking mechanism 16 is in a second position, thereby maintaining the bi-fold knife 2 in an open position. The insertion of this extended portion of the locking mechanism 16 in the slot 42 of hinge 10 thus prevents the hinge 10 from rotating and allowing the bi-fold knife 2 to close. Once a user inserts their finger into the handle aperture and moves the locking mechanism 16 by rotation about the lock pivot point 24, the locking mechanism 16 is removed from the slot 42, thus allowing hinge 10 to operate and collapse the bi-fold knife 2 into a closed position.

Figure 5:
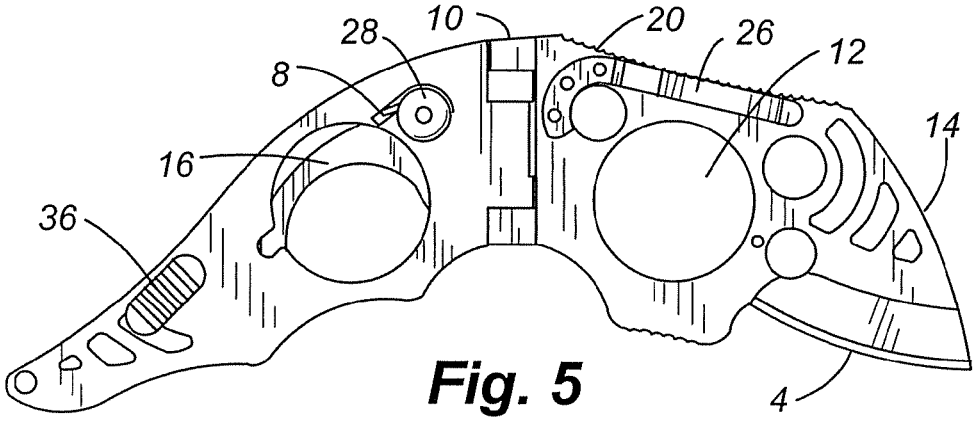
FIG. 5 is a rear elevation view of the bi-fold knife in FIG. 1.

Referring now in detail to FIG. 5, a rear elevation of the bi-fold knife 2 is shown. The bi-fold knife 2 also comprises on the handle portion 46 a finger lock 36 positioned on the handle. This finger lock 36 is movable from a first position to a second position and allows the bi-fold knife 2 to become locked in a closed position upon engagement of the détente mechanism 22 with the locking mechanism 16, as described in greater detail below in reference to FIGS. 8 and 9. Also shown in FIG. 5, the finger aperture 12 is aligned with the contours of the handle such that the hand of a user may easily grip the bi-fold knife 2 such that fingers may be placed on the contours shown on the handle portion 46 and one finger may be extended through the finger aperture 12 for easy purchase on the bi-fold knife 2. This improves the ability of a user to grasp and control the bi-fold knife 2.

Figure 6:
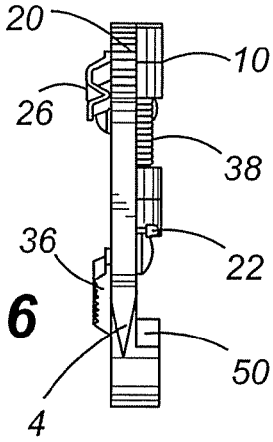
FIG. 6 is a left elevation view of the bi-fold knife in FIG. 1.
Figure 7:
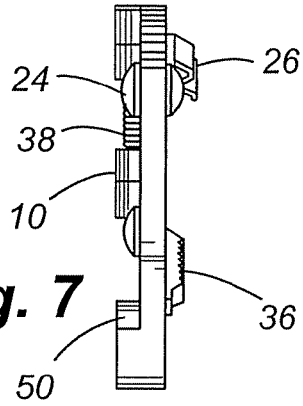
FIG. 7 is a right elevation view of the bi-fold knife of FIG. 1.

Referring now in detail to FIGS. 6 and 7, a left elevation view and right elevation view of the bi-fold knife 2 in one embodiment of the invention is shown. FIGS. 6 and 7 depict the bi-fold knife 2 in an open position, with FIG. 6 depicting an elevation view of the left side or the forward end of the blade portion 44 of the bi-fold knife 2, and FIG. 7 depicting an elevation view of the right side or rear end of the handle portion 46.

Figure 8:
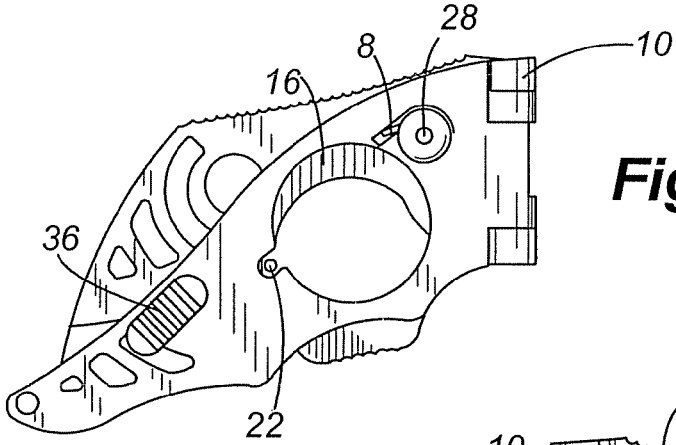
FIG. 8 is a front elevation view of the bi-fold knife of FIG. 3 in a closed position.

Referring now to FIG. 8, the bi-fold knife 2 in accordance with one embodiment is shown in a closed position. The handle has been collapsed against the blade portion 44 such that the handle portion 46 is connected to the blade portion 44 by engagement of the detent mechanism 22 with the locking mechanism 16. In one embodiment, the detent mechanism 22 is a post, which comprises a knob or other extended surface for achieving latching contact with the locking mechanism 16 when the blade portion 44 is folded to a closed position against the handle portion 46. A finger lock 36 is provided for locking the bi-fold knife 2 in a closed position once the locking mechanism 16 is moved to a second position as shown in FIG. 8. A locking plate 52 (as shown ill FIG. 3) is coupled to the finger lock 36, which may be moved from a first normal position to a second locked position. In the second locked position, locking plate 52 is positioned against locking mechanism 16 to prevent further counterclockwise rotation, thereby preventing bi-fold knife 2 from being opened accidentally. This is achieved by contact between the locking plate 52 and the locking mechanism 16 in its second position to prevent the locking mechanism 16 from pivoting about the lock pivot point 24 to release the detent mechanism 22. Once the finger lock 36 is moved back to its first normal position (and correspondingly, the locking plate 52 is moved back to its first normal position), the locking mechanism 16 is free to pivot and allow a user to open the bi-fold knife 2 to a position of use.

Figure 9:
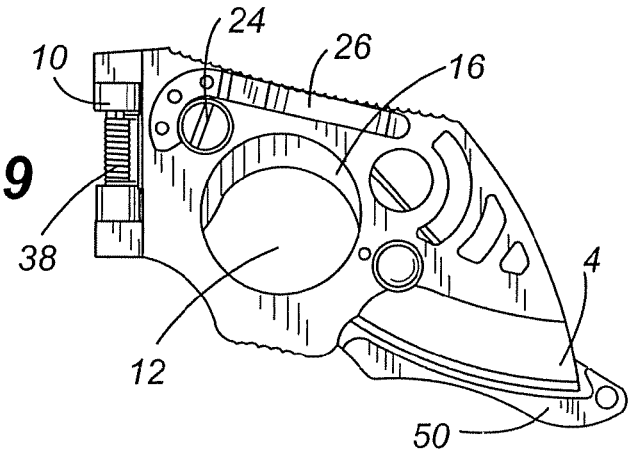
FIG. 9 is a rear elevation view of the bi-fold knife of FIG. 5 in a closed position.

Referring now to FIG. 9, another view of the bi-fold knife 2 according to one embodiment of the invention is shown in a closed position. The hinge 10 allows the blade portion 44 of the bi-fold knife 2 to fold and collapse against the handle portion 46 and the handle of the bi-fold knife 2, allowing the blade 4 to become recessed against the handle and the first extension 50 such that the blade 4 is protected and shielded from contact with the user. The detent mechanism 22 engages with the locking mechanism 16 such that the locking mechanism 16 overlaps the extended portion of the detent mechanism 22 after the detent mechanism 22 contacts and slides past a sloped surface 34 of the locking mechanism 16 and engages the rear surface of the locking mechanism 16 as described in greater detail below. The detent mechanism 22 thus creates a frictional latching connection with locking mechanism 16 to retain bi-fold knife 2 in a closed position.

Figure 10:
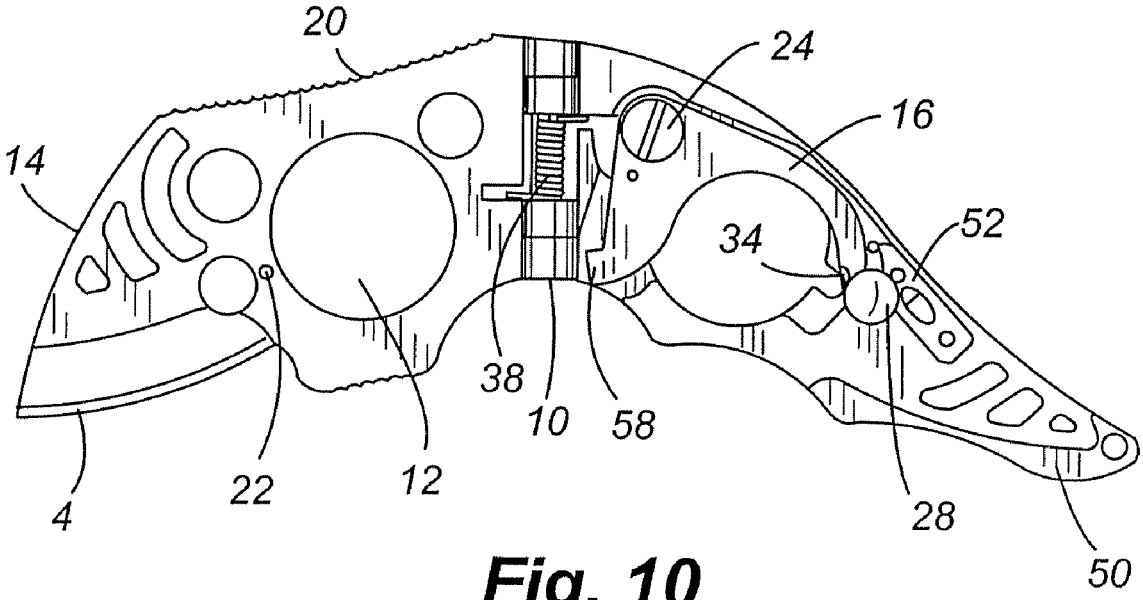
FIG. 10 is a front elevation view of the bi-fold knife of FIG. 1 with the locking mechanism in a second or released position.

Referring now to FIG. 10, another view of the bi-fold knife 2 according to one embodiment of the invention is shown with the locking mechanism 16 rotated to a position so as to disengage from hinge 10. As can be seen from the drawing, locking mechanism 16 in one embodiment comprises an extended portion or latch 58 for engaging the slot 42 in hinge 10 when the locking mechanism 16 is in a closed or released position (as shown in FIG. 4). Referring again to FIG. 10, however, locking mechanism 16 has been rotated so that the latch 58 is no longer engaged with slot 42, thus allowing the hinge 10 to operate by the force provided by biasing member 38 and the bi-fold knife 2 to become closed. Furthermore, the locking mechanism 16 may be rotated to this position to release the détente mechanism 22 and return the bi-fold knife 2 to an open position after being latched in a closed position.

In operation, a user may insert a finger into the finger aperture 12 and rotate the locking mechanism 16 by exerting force against the finger engagement surface 18, thereby causing locking mechanism 16 to rotate about the lock pivot point 24 and become disengaged from the slot 42 in hinge 10. The bi-fold knife 2 may be folded or collapsed by moving the blade portion 44 and the handle portion 46 axially so that the front surface of the blade portion 44 abuts the front surface of the handle portion 46. The biasing member 38 exerts minimal force such that movement of the blade portion 44 and handle portion 46 axially about hinge pin 32 is easily achieved. As shown in FIGS. 8 and 9, the bi-fold knife 2 is maintained in a closed position by engaging the detent mechanism 22 with the locking mechanism 16. The détente mechanism 22 is positioned on the blade portion 44 such that once bi-fold knife 2 is folded to a closed position, the detent mechanism 22 comes into contact with the sloped surface 34 of locking mechanism 16. As the detent mechanism 22 contacts sloped surface 34, locking mechanism 16 is biased in a generally counter-clockwise direction, allowing the detent mechanism 22 to slide along the sloped surface 34 of locking mechanism 16 and become engaged with the rear surface of locking mechanism 16. The spring 8 about lock pivot point 24 forces locking mechanism 16 to move slightly in a generally clockwise direction after the detent mechanism 22 has contacted the sloped surface 34, and thus the bi-fold knife 2 is secured in a closed position by latching of the detent mechanism 22 with the locking mechanism.

Similarly, the bi-fold knife 2 may be easily opened and the locking mechanism 16 securely inserted into the slot 42 for maintaining the bi-fold knife 2 in an opened position. This is accomplished by contacting the finger engagement surface 18 and rotating locking mechanism 16 slightly so that it becomes disengaged with the detent mechanism 22, thereby causing the biasing member 38 to force hinge 10 to rotate, locking mechanism 16 to engage slot 42 of hinge 10, and bi-fold knife 2 to be secured in a position of use.

To provide further clarity to the detailed description provided herein in the associated drawings, the following list of components and associated numbering are provided as follows:

| Component No. | Component |
|---|---|
| 02 | Bi-Fold Knife |
| 04 | Blade |
| 06 | Tang |
| 08 | Spring |
| 10 | Hinge |
| 12 | Finger Aperture |
| 14 | Spine |
| 16 | Locking Mechanism |
| 18 | Finger Engagement Surface |
| 20 | Serrated Edge |
| 22 | Detent Mechanism |
| 24 | Lock Pivot Point |
| 26 | Clip |
| 28 | Screws |
| 32 | Hinge Pin |
| 34 | Sloped Surface |
| 36 | Finger Lock |
| 38 | Biasing Member |
| 42 | Slot |
| 44 | Blade Portion |
| 46 | Handle Portion |
| 50 | First Extension |
| 52 | Locking Plate |
| 58 | Latch |

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the appended claims be construed to include alternative embodiments to the extent permitted by the prior art.

What is claimed is:

1. A folding knife comprising:

a blade having a front end and a tang;

a handle having a front end and a rear end, said tang of said blade rotatably interconnected to said front end of said handle by a hinge;

a slot positioned in at least one of said hinge and said tang;

a detent mechanism extending from said blade;

a locking mechanism for locking said blade in an open position or a closed position, said locking mechanism rotatable about a pivot point from a first position to a second position;

said folding knife further comprising a sliding button on said handle and proximate said locking mechanism, said sliding button coupled to a locking plate and movable from a first position to a second position, wherein when in the second position said locking plate is positioned against the locking mechanism to prevent the locking mechanism from pivoting about the pivot point and to prevent release of the detent mechanism and wherein a latch on said locking mechanism engages said slot in said first position for locking said folding knife in said open position, wherein said latch is released from said slot to allow the rotation of said blade and said handle to said closed position, and wherein said detent mechanism contacts and engages said locking mechanism for locking said blade in said closed position.

2. The folding knife of claim 1 wherein said blade is substantially symmetrical to said handle.

3. The folding knife of claim 1 wherein said blade further comprises at least one finger aperture.

4. The folding knife of claim 1 wherein said locking mechanism is attached to said handle at said pivot point.

5. The folding knife of claim 4 wherein said pivot point further comprises a biasing member which causes said locking mechanism to rotate to said first position.

6. The folding knife of claim 1 wherein said detent mechanism is positioned on said blade of said folding knife and in operable contact with said locking mechanism in said second position such that said blade is impeded from opening when said folding knife is in said closed position.

7. The folding knife of claim 1 wherein said locking mechanism is rotated to a third position for releasing said detent mechanism and releasing said folding knife from said closed position.

8. The folding knife of claim 1 wherein said handle further comprises at least one extension for accommodating said blade when said folding knife is in said closed position.

9. A folding knife comprising:

a first portion comprising at least one blade and a hinge;

a second portion connected to said first portion by said hinge;

a locking post extending from said first portion;

a locking mechanism attached to at least a part of said second portion and pivotable about a pivot point for locking said folding knife in an open position or a closed position;

wherein said locking mechanism is in operable contact with said first portion in a first position for locking said folding knife in said open position, and wherein said locking mechanism is in operable contact with said locking post in a second position for locking said folding knife in said closed position; and wherein said locking mechanism further comprises at least one sloped surface on a first side of said locking mechanism for operably engaging said locking post such that the locking post contacts and slides past the sloped surface to engage a rear surface of the locking mechanism for creating a frictional latching connection with the locking mechanism to retain the knife in the closed position.

10. The folding knife of claim 9 wherein said first portion is substantially symmetrical to said second portion.

11. The folding knife of claim 9 wherein said first portion further comprises at least one aperture for inserting a finger to grasp said folding knife.

12. The folding knife of claim 9 wherein said locking mechanism is rotated to a third position for releasing said locking post and releasing said folding knife from said closed position.

13. The folding knife of claim 9 wherein said pivot point further comprises a biasing member which causes said locking mechanism to rotate to said first position.

14. The folding knife of claim 9 wherein said second portion further comprises at least one extension for accommodating said blade when said folding knife is in said closed position.

15. A folding knife comprising:

a first portion comprising at least one blade and a hinge;

a second portion connected to said first portion by said hinge;

a locking post extending from said first portion;

a locking mechanism attached to and pivotable about at least a part of said second portion for locking said folding knife in an open position or a closed position;

wherein said locking mechanism further comprises at least one sloped surface on a first side of said locking mechanism for operably engaging said locking post on a second side of said locking mechanism for retaining the folding knife in the closed position;

said folding knife further comprising a sliding button on said second portion and proximate said locking mechanism, said sliding button coupled to a locking plate and movable from a first position to a second position, wherein when in the second position said locking plate is positioned against the locking mechanism to prevent further counterclockwise rotation of the locking mechanism and to prevent release of the locking post; and wherein said locking mechanism is in operable contact with said first portion in a first position for locking said folding knife in said open position, and wherein said locking mechanism is in operable contact with said locking post in a second position for locking said folding knife in said closed position.

* * * * *